US006346295B1

(12) United States Patent
Riesop et al.

(10) Patent No.: US 6,346,295 B1
(45) Date of Patent: Feb. 12, 2002

(54) ALKALINE STRIP PASSIVATION

(75) Inventors: Joerg Riesop; Heike Krautbauer, both of Kerpen (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/485,275

(22) PCT Filed: Jul. 25, 1998

(86) PCT No.: PCT/EP98/04670

§ 371 Date: Apr. 5, 2000

§ 102(e) Date: Apr. 5, 2000

(87) PCT Pub. No.: WO99/07917

PCT Pub. Date: Feb. 18, 1999

(30) Foreign Application Priority Data

Aug. 6, 1997 (DE) ..... 197 33 972

(51) Int. Cl.[7] ..... B05D 1/36; B05D 7/14

(52) U.S. Cl. ..... 427/353; 427/388.4; 427/409; 427/419.1; 148/243; 148/274; 148/275; 148/283

(58) Field of Search ..... 427/388.1, 388.4, 427/409, 353, 419.1; 148/240, 243, 248, 251, 274, 275, 283

(56) References Cited

U.S. PATENT DOCUMENTS 3,444,007 A * 5/1969 Maurer et al. ..... 148/6.15
3,895,970 A 7/1975 Blum et al. ..... 148/6.15
4,801,337 A * 1/1989 Higgins ..... 148/6.2
5,294,266 A 3/1994 Gayffe et al. ..... 147/246
5,584,946 A * 12/1996 Karmaschek et al. ..... 148/247

FOREIGN PATENT DOCUMENTS

| | | |
|---|---|---|
| DE | 3349043 | * 10/1967 |
| EP | 0405340 | 1/1991 |
| EP | 433118 A1 | * 6/1991 |
| EP | 0459549 | 12/1991 |
| GB | 1042108 | 9/1966 |
| WO | WP91/7109 | 6/1996 |

* cited by examiner

*Primary Examiner*—Erma Cameron
(74) *Attorney, Agent, or Firm*—Wayne C. Jaeschke; Stephen D. Harper

(57) ABSTRACT

Process for the alkaline passivation of galvanized and alloy-galvanized steel surfaces and of aluminum in strip lines, wherein the metal surfaces are brought into contact with an alkaline aqueous solution that contains complexing agents and iron, which has a free alkalinity in the range of 5 to 20 points and a total alkalinity in the range of 7 to 30 points and contains:

0.1 to 1 g/l magnesium ions, 0.1 to 1 g/l iron (III) ions and 0.5 to 5 g/l amino or hydroxy carboxylate ions. This may be followed by a chrome-containing or chrome-free secondary passivation.

12 Claims, No Drawings

ALKALINE STRIP PASSIVATION

This application is filed under 35 U.S.C. 371 and based on PCT/EP98/04670, filed Jul. 25, 1998.

BACKGROUND OF THE INVENTION

1. Field of the Invention

This invention relates to a process for the alkaline passivation of galvanized and alloy-galvanized steel surfaces and of aluminum and alloys thereof in strip lines. As a result of this passivation, an anticorrosive coat is formed which may serve as a base for subsequent lacquering.

2. Discussion of Related Art

Alkaline passivation processes have long been known for treating the metal surfaces mentioned. In order to achieve adequate corrosion protection and the required lacquer adhesion, the treatment solutions generally contain toxic heavy metals, such as nickel ions and/or cobalt ions. These ions are held in solution under the alkaline conditions by suitable complexing agents. Examples of such passivation solutions are given in EP-A-405 340.

Satisfactory results in terms of corrosion protection and lacquer adhesion are obtained as a result of the presence of nickel and/or cobalt ions in the alkaline passivation solution. However, owing to the high toxicity, the necessary workers' protection measures and the costly waste disposal, there are reservations about the use of toxic heavy metals, such as nickel or cobalt. An objection of the present invention is therefore providing a process for the alkaline passivation of suitable metal surfaces, the efficiency of which is similar to that of nickel or cobalt-containing processes, but which does not use toxic heavy metals.

This object is achieved by a process for the alkaline passivation of galvanized and alloy-galvanized steel surfaces and of aluminum in strip lines, wherein the metal surfaces are brought into contact with an alkaline aqueous solution which contains complexing agents and iron, wherein the aqueous solution has a free alkalinity in the range of 5 to 20 points and a total alkalinity in the range of 7 to 30 points and contains:

0.1 to 1 g/l magnesium ions, 0.1 to 1 g/l iron (III) ions and 0.5 to 5 g/l amino or hydroxycarboxylate ions.

"Aluminum" here means aluminum and aluminum alloys which contain more than 50% w/w aluminum.

"Alkaline" means that the treatment solutions have a pH of more than 9.5, preferably in the range of 10 to 13. In practice, the free alkalinity and total alkalinity contents are used rather than the pH values to characterize the treatment baths. The free alkalinity is determined by titrating 2 ml of bath solution, preferably diluted to 50 ml, with a 0.1 N acid, such as hydrochloric acid or sulfuric acid, to a pH of 8.5. The acid solution consumed in ml gives the point value of the free alkalinity. The total alkalinity is determined in the same way by titrating 2 ml of treatment solution, diluted to 50 ml, with 0.1 N acid to a pH of 4.0. This necessarily means that the total alkalinity is higher than the free alkalinity.

The treatment solution may contain additional active substances which have a positive effect on coat formation and corrosion protection. Contents of about 0.001 to about 20 g/l of fine-particle $SiO_2$, for example pyrogenic silica, may be mentioned as an example. Pyrogenic silica having a specific surface (BET) in the range of about 150 to about 300 $m^2/g$, for example about 200 $m^2/g$, is preferably used. Aqueous suspensions of such silicas are commercially available.

A further optional component of the treatment solution is about 0.001 to about 10 g/l of monomeric or oligomeric acrylate and/or methacrylate ions. These may be added to the treatment solution as soluble salts, for example sodium salts, or in the form of the free acid. In the subsequent drying step, at the latest when a lacquer that has been applied is stoved, these ions polymerise, thus improving the coat properties.

The amino or hydroxycarboxylate ions serve to prevent the precipitation of iron and magnesium compounds at the alkaline pH of the treatment solution. In principle, all amino or hydroxycarboxylate ions which bring about this effect are suitable for this purpose. They may be introduced into the treatment solution in the form of soluble salts, such as sodium salts, or as free acids. Monobasic hydroxycarboxylic acids with at least four carbon atoms and at least two alcoholic hydroxyl groups are preferred. Gluconate ions or the one carbon atom longer glucoheptanate ions are particularly preferred.

Apart from these constituents, the treatment solutions also contain the anions of the salts in the form of which the magnesium and iron (III) ions were introduced into the treatment solution. The nitrates are preferably used since nitrate ions do not have a negative effect on corrosion protection.

The process is designed for the treatment of continuous metal strips, so the treatment time is in the range of just a few seconds, depending on the line speed and length of the treatment zone. The duration of treatment may, for example, be about 3 to about 30 seconds and is preferably in the range of 5 to 15 seconds. The metal surfaces are preferably brought into contact with an aqueous treatment solution which has a temperature in the range of about 40 to about 70° C. Spraying, dipping and roll coating processes are suitable methods of contacting. Spray application is usual and is suitable in the present context. At the end of the desired reaction time, the aqueous treatment solution is rinsed off.

The corrosion protection effect may be improved further if the alkalinically-passivated metal surfaces are subjected to secondary passivation. Chrome-containing processes are widespread in the art for secondary passivation, following alkaline passivation. Chrome-containing secondary passivation is also suitable as an after-treatment following the alkaline passivation according to the present invention. However, a particular advantage of the process according to the present invention lies in the fact that an ecologically and toxicologically problematic chrome-containing after-treatment may be omitted and instead, a chrome-free secondary passivation may be carried out. Aqueous solutions which contain titanium and/or zirconium compounds, particularly complex fluorides of these elements, are particularly suitable as chrome-free secondary passivation solutions. For example, such a secondary passivation solution may contain a total of 0.4 to 10 g/l of complex fluorides of titanium and/or zirconium. The pH of this chrome-free secondary passivation solution is preferably in the range of about 2 to about 4.

The alkaline passivation step according to the present invention thus represents one treatment step in a multi-step chain of treatment in which the metal strips are usually first degreased and rinsed. The alkaline passivation according to the present invention follows this, usually followed by the steps of rinsing, secondary passivation, usually rinsing again, drying (at about 60 to about 100° C. object temperature), lacquering.

In principle, the alkaline passivation solution may be prepared in situ by dissolving the individual constituents in water in the concentration required for use. In practice, however, it is usual to make concentrates and to transport them to the treatment plant where the ready-to-use treatment solution is prepared by simply diluting with water. Accordingly, the present invention also comprises an aqueous concentrate which, when diluted with water by a factor in the range of 7 to 15, gives an aqueous treatment solution for the alkaline passivation of galvanized and alloy-galvanized steel surfaces and of aluminum in strip lines, which has a free alkalinity in the range of 5 to 20 points and a total alkalinity in the range of 7 to 30 points and contains:

0.1 to 1 g/l magnesium ions, 0.1 to 1 g/l iron (III) ions and 0.5 to 5 g/l amino or hydroxycarboxylate ions.

In producing these concentrates, preferably magnesium and iron salts, preferably nitrates, are first dissolved in water to the required concentration, the complexing carboxylic acid is then added and only then is the alkaline pH adjusted by adding lye, for example sodium hydroxide solution.

DESCRIPTION OF THE INVENTION

EXAMPLES

The following Examples show that the alkaline passivation process according to the present invention leads to corrosion protection results similar to those of comparable known processes which contain toxic nickel and/or cobalt ions. The galvanized and alloy-galvanized steel plates mentioned in Table 2 were alkalinically-passivated according to Table 1, rinsed with water for 5 seconds, subjected to secondary passivation using chrome-containing or chrome-free secondary rinsing solutions (treatment time: 5 seconds spraying), rinsed using deionised water for 2 seconds and dried in a circulating-air drying cupboard at a cupboard temperature of 70° C. For the lacquering, 5 $\mu$m of primer and 18 $\mu$m of top coat, both polyester-based, were applied and stoved at 216 or 249° C. The test plates were then subjected to a 42-day salt spray test according to German standard DIN 50 021 SS. The results (lacquer creepage in mm on the section and on the edge) are reproduced in Table 2. In addition, lacquer adhesion was investigated by a T-bend test. No significant differences were shown between the process according to the present invention and the comparable processes using nickel and/or cobalt.

TABLE 1

Alkaline passivation solutions and treatment conditions

| Ex. No. | FA[1] (ml) | TA[2] (ml) | Temp (° C.) | Time (s) | Co g/l | Ni g/l | Fe g/l | Mg g/l | Complex[3] g/l | $SiO_2$[4] g/l | Acrylic g/l | Secondary rinse used |
|---|---|---|---|---|---|---|---|---|---|---|---|---|
| Comp. 1 | 5 | 7 | 55 | 10 | 0.29 | 0 | 0.21 | 0 | 1.8 | 0 | 0 | Chrome[5] |
| Comp. 2 | 5 | 7 | 55 | 10 | 0.29 | 0 | 0.21 | 0 | 1.8 | 0 | 0 | Chrome-free[6] |
| Comp. 3 | 6 | 8 | 60 | 20 | 0.29 | 0.21 | 0.21 | 0 | 1.8 | 0 | 0 | Chrome |
| Comp. 4 | 6 | 8 | 60 | 20 | 0.29 | 0.21 | 0.21 | 0 | 1.8 | 0 | 0 | Chrome-free |
| Comp. 5 | 5 | 7 | 60 | 30 | 0.16 | 0 | 0.21 | 0.23 | 1.8 | 8.6 | 0 | Chrome |
| Ex. 1 | 7 | 9 | 60 | 15 | 0 | 0 | 0.21 | 0.33 | 1.8 | 0 | 0 | Chrome |
| Ex. 2 | 6 | 8 | 60 | 15 | 0 | 0 | 0.21 | 0.33 | 1.8 | 0 | 0 | Chrome-free |
| Ex. 3 | 5 | 7 | 60 | 10 | 0 | 0 | 0.21 | 0.33 | 1.8 | 8.6 | 0 | Chrome |
| Ex. 4 | 5 | 7 | 60 | 10 | 0 | 0 | 0.21 | 0.33 | 1.8 | 8.6 | 0 | Chrome-free |
| Ex. 5 | 6 | 8 | 60 | 10 | 0 | 0 | 0.21 | 0.33 | 1.8 | 0 | 5.7 | Chrome-free |
| Ex. 6 | 5 | 7 | 65 | 10 | 0 | 0 | 0.15 | 0.15 | 0.8 | 0.5 | 0 | Chrome-free |
| Ex. 7 | 19 | 29 | 45 | 10 | 0 | 0 | 9.90 | 1.0 | 5.0 | 0 | 9.2 | Chrome-free |
| Ex. 8 | 10 | 15 | 60 | 10 | 0 | 0 | 0.21 | 0.6 | 2.4 | 17 | 0 | Chrome-free |

[1]Free alkalinity (cf. text)
[2]Total alkalinity (cf. text)
[3]Complexing agent: glucoheptanate
[4]Pyrogenic silica; specific surface 200 $m^2/g$
[5]Chrome-containing secondary passivation solution (1.5 g/l Cr (VI); pH 3.2)
[6]Chrome-free secondary passivation solution based on $TiF_6^{2-}$ (0.5 g/l, pH 3.4)

TABLE 2

Corrosion test results (42-day salt spray test)

| | Z[1] Creepage in mm on | | ZA[2] Creepage in mm on | | AZ[3] Creepage in mm on | |
|---|---|---|---|---|---|---|
| Treatment | section | edge | section | edge | section | edge |
| Comp. 1 | 2.5 | 24 | 3 | 17 | 4.5 | 30 |
| Comp. 2 | 2.7 | 18 | 6.5 | 18 | 4.5 | 30 |
| Comp. 3 | 1.8 | 24 | 0.2 | 8 | 0.4 | 13 |
| Comp. 4. | 4.5 | 18 | 0.2 | 7 | 4.1 | 21 |
| Comp. 5 | 1.6 | 30 | 0.6 | 7 | 0.4 | 40 |
| Example 1 | 2.8 | 27 | 0.7 | 7 | 0.4 | 22 |
| Example 2 | 3.2 | 17 | 5 | 16 | 1.7 | 8 |
| Example 3 | 1.5 | 32 | 1.3 | 8 | 0.5 | 34 |
| Example 4 | 1.2 | 26 | 0.4 | 8 | 1.1 | 26 |
| Example 5 | 2.2 | 10 | 3 | 16 | 0.8 | 12 |
| Example 6 | 1.8 | 15 | | | | |
| Example 7 | 1.5 | 13 | | | | |
| Example 8 | 2.4 | 12 | | | | |

[1]Hot-dip galvanized steel
[2]Alloy-galvanized steel with 95% Zn, 5% Al (Galfan[R])
[3]Alloy-galvanized steel with 45% Zn, 55% Al (Galvalume[R])

What is claimed is:

1. A process for the alkaline passivation of a metal surface selected from the group consistng of galvanizd steel, alloy-galvanized steel and aluminum comprising:

a) forming an alkaline aqueous solution comprising:

1) 0.1 to 1 gl of magnesium ions;

2) 0.1 to 1 g/l of iron (III) ions; and 3) 0.5 to 5 g/l amino or hydroxycarboxylate ions;

4) 0.001 to 10 g/l of a member selected from the group consisting of acrylic acid ions, methacrylic acid ions, oligomers comprising acrylic acid residues, oligomers comprising methacrylic acid residues and mixtures thereof;

wherein said aqueous solution has a free alkalinity in the range of 5 to 20 points and a total alkalinity in the range of 7 to 30 points; and b) containing the metal surface with the alkaline aqueous solution.

2. The process of claim 1 wherein said aqueous solution further comprises 0.001 to 20 g/l of pyrogenic silica.

3. The process of claim 1 wherein said hydroxycarboxylate ions are selected from the group consisting of monobasic hydroxycarboxylic acids with at least four carbon atoms and at least two alcoholic hydroxyl groups.

4. The process of claim 1 wherein said hydroxycarboxylate ions are selected from the group consisting of gluconate ions, glucoheptanate ions, and mixtures thereof.

5. The process of claim 1 wherein magnesium and iron nitrate are the source of said magnesium and iron (III) ions.

6. The process of claim 1 wherein said aqueous solution contacts said metal surface for 3 to 30 seconds.

7. The process of claim 6 wherein said aqueous solution contacts said metal surface for 5 to 15 seconds.

8. The process of claim 1 wherein said aqueous solution contacting said metal surface is at a temperature of from 40 to 70° C.

9. The process of claim 1 further comprising rinsing said metal surface with water following contact with the aqueous solution, then treating said metal surface with a chrome-free secondary passivation solution comprising 0.4 to 10 g/l of complex fluorides of titanium, zirconium, or a mixture thereof.

10. The process of claim 9 wherein said secondary passivation solution has a pH of from 2 to about 4.

11. The process of claim 9 further comprising drying said metal surface, following primary and secondary passivation treatments, at from 60 to 100° C., followed by lacquering.

12. The process of claim 1 wherein an aqueous concentrate is diluted with water by a factor of from 7 to 15 to provide the alkaline aqueous solution.

* * * * *

UNITED STATES PATENT AND TRADEMARK OFFICE

CERTIFICATE OF CORRECTION

PATENT NO. : 6,346,295 B1
DATED : February 12, 2002
INVENTOR(S) : Riesop et al.

It is certified that error appears in the above-identified patent and that said Letters Patent is hereby corrected as shown below:

Column 4,
Line 56, delete “consistng”, and insert therefor -- consisting --.
Line 56, delete “galvanizd”, and insert therefor -- galvanized --.
Line 60, after “1”, delete “gl”, and insert therefor -- g/l --.

Column 5,
Line 4, delete “containing”, and insert therefor -- contacting --.

Signed and Sealed this

Twenty-sixth Day of August, 2003

JAMES E. ROGAN
*Director of the United States Patent and Trademark Office*